US007950354B2

(12) United States Patent
Kawahara et al.

(10) Patent No.: US 7,950,354 B2
(45) Date of Patent: May 31, 2011

(54) OIL-COOLED ENGINE

(75) Inventors: Minoru Kawahara, Osaka (JP); Shingo Izumi, Osaka (JP); Takahiro Kajihara, Osaka (JP)

(73) Assignee: Kubota Corporation, Osaka (JP)

( * ) Notice: Subject to any disclaimer, the term of this patent is extended or adjusted under 35 U.S.C. 154(b) by 453 days.

(21) Appl. No.: 12/206,025

(22) Filed: Sep. 8, 2008

(65) Prior Publication Data

US 2009/0064947 A1 Mar. 12, 2009

(30) Foreign Application Priority Data

Sep. 11, 2007 (JP) ..... 2007-234823

(51) Int. Cl.
*F01P 3/00* (2006.01)
*F01M 1/02* (2006.01)

(52) U.S. Cl. ..... 123/41.42; 123/196 R

(58) Field of Classification Search ..... 123/41.42, 123/196 R

See application file for complete search history.

(56) References Cited

FOREIGN PATENT DOCUMENTS

JP 63-183214 A 7/1988

*Primary Examiner* — Noah Kamen

(74) *Attorney, Agent, or Firm* — Panitch Schwarze Belisario & Nadel LLP

(57) ABSTRACT

An oil-release space (18) is formed along a lower side portion (17) of a cylinder lateral and peripheral wall (3) below an oil-cooling jacket (4). A reinforcing plate (19) spans between the lower side portion (17) of the cylinder lateral and peripheral wall (3) and a bottom wall (10) of a push-rod chamber (8) below the oil-release space (18). The oil-release space (18) is communicated with an oil outlet (20) of an oil-return passage (7). Engine oil that has passed through the oil-return passage (7) is released from the oil outlet (20) into the oil-release space (18). The engine oil released into the oil-release space (18) is guided by an upper surface of the reinforcing plate (19) to drop from a led-out end (25) on a rear side of the reinforcing plate (19) onto a rear side space (24).

11 Claims, 5 Drawing Sheets

OIL-COOLED ENGINE

BACKGROUND OF THE INVENTION

1. Technical Field

The present invention relates to an oil-cooled engine and more particularly concerns an oil-cooled engine capable of reducing the oil-consumption amount.

2. Background of the Art

A conventional example of those oil-cooled engines comprises a cylinder along a lateral and peripheral wall of which an oil-cooling jacket is formed as well as the present invention. An oil-return passage and a push-rod chamber are formed along a lateral and peripheral wall of the oil-cooling jacket disposed, opposite to the cylinder lateral and peripheral wall with the oil-cooling jacket interposed between the cylinder lateral and peripheral wall and the oil-cooling jacket lateral and peripheral wall. The oil-return passage and the push-rod chamber are directed in an up and down direction so that an oil pump feeds engine oil under pressure, which is then returned from the oil-return passage into a crank case. The push-rod chamber has a bottom wall which is opened to provide a tappet-guide hole into which a tappet is internally fitted and below which a valve-operating cam shaft spans in a front and rear direction and has a cam on which a tappet is placed (for example, see Patent Literature 1).

However, in the conventional oil-cooled engine, the push-rod chamber has the bottom wall opened to provide an oil outlet for the oil-return passage, which is located just above a fuel injection cam immediately laterally and slantly downwards of a mid side portion of the cylinder lateral and peripheral wall and therefore causes problems.

[Patent Literature 1]

Patent Application Laid-Open No. 63-183214 (see FIG. 4)

DISCLOSURE OF THE INVENTION

Problem the Invention Attempts to Solve

The above-mentioned conventional art has the following problems.

<Problem> The oil-consumption amount is large.

The engine oil flowed out from the oil outlet of the oil-return passage is splashed up by the fuel injection cam toward the mid side portion of the cylinder lateral and peripheral wall. This causes excessive amount of oil mist to invade the cylinder, thereby increasing the oil that enters from a gap between the cylinder and the piston in amount with the result of consuming a large amount of oil.

<Problem> If an external piping is used for the oil-return passage, there is caused a new problem of oil leak due to the damaged oil-return passage.

In order to solve the above problem, it is envisaged to use the external piping for the oil-return passage and return the engine oil to a position far away from the valve-operating cam shaft. However, in this case, the oil-return passage is liable to be damaged and therefore the problem of oil leak occurs anew due to this damage.

SUMMARY OF THE INVENTION

The present invention has an object to provide an oil-cooled engine able to solve the above problems and more specifically an oil-cooled engine capable of reducing the oil-consumption amount.

Means for Solving the Problem

The inventive featuring matter of the invention as defined in claim 1 is as follows.

As exemplified in FIG. 5, where a direction in which a cylinder center axis 1 extends is taken as an up and down direction and a direction in which a center axis of a crank shaft extends is deemed as a front and rear direction, a direction perpendicular to these directions being regarded as a left and right lateral direction, formed along a cylinder lateral and peripheral wall 3 is an oil-cooling jacket 4. An oil-return passage 7 and a push-rod chamber 8 are formed along a lateral and peripheral wall 6 of the oil-cooling jacket 4, disposed opposite to the cylinder lateral and peripheral wall 3, with the oil-cooling jacket 4 interposed between the cylinder lateral and peripheral wall 3 and the oil-cooling jacket lateral and peripheral wall 6. The oil-return passage 7 and the push-rod chamber 8 are oriented in the up and down direction and an oil pump feeds under pressure engine oil to the oil-cooling jacket 4, which is returned from the oil-return passage 7 into a crank case 9.

As exemplified in FIG. 1, an oil-cooled engine includes the push-rod chamber 8 which has a bottom wall 10 opened to provide tappet guide holes 11, 11, into which tappets 12, 12 are internally fitted and below which a valve-operating cam shaft 13 spans in a front and rear direction and has cams 14, 15 on which the tappets 12, 12 are placed.

In this oil-cooled engine, as shown in FIG. 2, an oil-release space 18 is defined along a lower side portion 17 of the cylinder lateral and peripheral wall 3 below the oil-cooling jacket 4. A reinforcing plate 19 spans between the lower side portion 17 of the cylinder lateral and peripheral wall 3 and the push-rod chamber bottom wall 10 below the oil-release space 18. The oil-return passage 7 has an oil outlet 20 communicated with the oil-release space 18, into which the engine oil that has passed through the oil-return passage 7 is released from the oil outlet 20.

As illustrated in FIG. 1, when seen in a direction parallel to the cylinder center axis 1, the valve-operating cam shaft 13 has one end portion to which a valve-operating cam gear 21 is attached. A side where the one end portion of the valve-operating cam shaft 13, which has the valve-operating cam gear 21 attached thereto, is present is deemed to be a rear side. The valve-operating cam shaft 13 is provided with a plurality of cams, the rearmost one of which is taken as a rear cam 15. The reinforcing plate 19 is led out from a front end of the oil-release space 18 to a rear side portion from the rear cam 15 of the valve-operating cam shaft 13. The rear cam 15 and the valve-operating cam gear 21 define a portion which is deemed as a rear side portion 22 of the cam shaft. A space present immediately laterally of the cam-shaft rear side portion 22 on the side of the cylinder lateral and peripheral wall 3 is taken as a rear side space 24.

The oil-cooled engine is characterized in that the engine oil released into the oil-release space 18 is guided by an upper surface of the reinforcing plate 19 and is made to drop from a led-out end 25 disposed on a rear side of the reinforcing plate 19 onto the rear side space 24.

EFFECT OF THE INVENTION

Invention of Claim 1

<Effect> The amount of the oil-consumption can be reduced.

As exemplified in FIG. 1, the engine oil released into the oil-release space 18 is guided by the upper surface of the reinforcing plate 19 and is made to drop from the led-out end 25 on the rear side of the reinforcing plate 19 onto the rear side space 24. Thus the engine oil flowed out from the oil outlet 20 goes far away from the cams 14, 15 of the valve-operating cam shaft 13 and is unlikely to be splashed up to the mid side portion 31 of the cylinder lateral and peripheral wall 3. This optimizes the oil-mist, in amount, that invades the cylinder 5 to reduce the amount of the oil, which enters from the gap between the cylinder 5 and the piston 34 to result in the possibility of decreasing the oil-consumption amount.

<Effect> High function of reducing the oil-consumption amount.

As exemplified in FIG. 1, the reinforcing plate 19 spans between the lower side portion 17 of the cylinder lateral and peripheral wall 3 and the push-rod chamber bottom wall 10. Therefore, the reinforcing plate 19 increases the strength of the lower side portion 17 of the cylinder lateral and peripheral wall 3. Further, the engine oil released into the oil-release space 18 is guided by the upper surface of the reinforcing plate 19, thereby allowing the heat of the lower side portion 17 of the cylinder lateral and peripheral wall 3 to be optimally radiated into the engine oil via the reinforcing plate 19. For these reasons, the cylinder lateral and peripheral wall 3 hardly undergoes heat strain. This reduces the amount of the oil that invades from the gap between the cylinder 5 and the piston 34 attributable to the heat strain of the cylinder lateral and peripheral wall 3 and as a result enhances the function of decreasing the oil-consumption amount.

<Effect> The tappet is hardly damaged.

As shown in FIG. 1, the reinforcing plate 19 spans between the lower side portion 17 of the cylinder lateral and peripheral wall 3 and the push-rod chamber bottom wall 10 and, as a result, increases the strength of the push-rod chamber bottom wall 10. Further, the engine oil released into the oil-release space 18 is guided by the upper surface of the reinforcing plate 19 and therefore the push-rod chamber bottom wall 10 has its heat optimally released to the engine oil via the reinforcing plate 19. For these reasons, the push-rod chamber bottom wall 10 hardly experiences the heat strain. Accordingly, the tappet is hardly damaged due to this heat strain.

<Effect> The problem of oil leak hardly occurs due to the damaged oil-return passage.

Being an internal piping, the oil-return passage 7 is hardly damaged to result in hardly causing the problem of oil leak attributable to the damaged oil-return passage 7.

Invention of Claim 2

The invention as defined in claim 2 makes the effect produced by the invention of claim 1 more remarkable.

Invention of Claim 3

In addition to the effects offered by the invention as defined in claim 1, it offers the following effect.

<Effect> It has a high function of reducing the oil-consumption amount.

As exemplified in FIG. 2, the cylinder lateral and peripheral wall 3, the push-rod chamber bottom wall 10 and the reinforcing plate 19 are parts of an integrally formed one-piece cast product including those ones. In consequence, the heat of the cylinder lateral and peripheral wall 3 is easily transmitted to the reinforcing plate 19 and is readily released via the reinforcing plate 19 to the engine oil. As a result, the cylinder lateral and peripheral wall 3 is hardly susceptible to the heat strain, attributable to which the oil that invades from the gap between the cylinder 5 and the piston 34 decreases in amount to enhance the function of decreasing the oil-consumption amount.

<Effect> The tappet is hardly damaged.

As exemplified in FIG. 2, the cylinder lateral and peripheral wall 3, the push-rod chamber bottom wall 10 and the reinforcing plate 19 are parts of an integrally formed one-piece cast product. In consequence, the heat of the push-rod chamber bottom wall 10 is easily transmitted to the reinforcing plate 19 and is readily released via the reinforcing plate 19 to the engine oil. As a result, the push-rod chamber bottom wall 10 hardly undergoes the heat strain. Thus the tappet 12 is hardly damaged attributable to this heat strain.

Invention of Claim 4

In addition to the effects offered by the invention as defined in claim 1, it presents the following effect.

<Effect> The tappet is hardly damaged.

As shown for example only in FIG. 1, a reinforcing plate 19 being provided immediately laterally of each of the tappet-guide holes 11, 11, every tappet-guide hole 11 is inhibited from experiencing the heat strain at its peripheral thick portion to result in hardly damaging the tappet 12.

Invention of Claim 5

In addition to the effects given by the invention as defined in claim 1, it offers the following effect.

<Effect> It is possible to reduce the oil-consumption amount.

As exemplified in FIG. 1, the cylinder lateral and peripheral wall 3 which forms a lateral wall of the oil-release space 18 goes further way from the valve-operating cam shaft 13 as it approaches the led-out end 25 at the rear side of the reinforcing plate 19. This makes the engine oil flowed out from the oil outlet 20 easily go far away from the cams 14, 15 of the valve-operating cam shaft 13 and is unlikely to be splashed up to the mid side portion 31 of the cylinder lateral and peripheral wall 3. Owing to this arrangement, the amount of the oil mist that enters the cylinder 5 is optimized and the oil that invades from the space between the cylinder 5 and the piston 34 is reduced in amount with the result of being able to decrease the oil-consumption amount.

Invention of Claim 6

In addition to the effects afforded by the invention as defined in claim 1, it offers the following effect.

<Effect> It is possible to conduct the engine oil into the oil-release space with a simple passage structure.

As shown in FIG. 2, a laterally oriented hole 28 crosses the push-rod chamber bottom wall 10. And the oil-return passage 7 crosses the laterally oriented hole 28. A portion of the laterally oriented hole 28 which is nearer the oil-release space 18 than the crossing portion **28*a* with the oil-return passage 7 is taken as the oil outlet 20. An outside opening 31 of the laterally oriented hole 28, disposed opposite to the oil-release space 18 is sealed by a plug 32. Therefore, the engine oil can be conducted to the oil-release space 18** with a simple passage structure.

Invention of Claim 7

In addition to the effect afforded by the invention as defined in claim 6, it offers the following effect.

<Effect> The tappet is hardly damaged.

As shown in FIG. 1 for example only, a laterally oriented oil reservoir **28*b* is located between a pair of tappet-guide holes 11, 11 adjacent each other. Therefore, an area for releasing the heat from the push-rod chamber bottom wall 10 to the engine oil is spread between the tappet-guide holes 11 and 11, enabling the friction heat of the tappets 12, 12 to be easily radiated with the result of hardly damaging the tappets 12, 12**.

Invention of Claim 8

In addition to the effects presented by the invention as defined in claim 6, it offers the following effect.

<Effect> The tappet is hardly damaged.

As shown in FIG. 1 for example only, a downwardly oriented oil reservoir 30 is located between the paired tappet-guide holes 11, 11 adjacent each other. Therefore, the area for releasing the heat from the push-rod chamber bottom wall 10 to the engine oil is spread between the tappet-guide holes 11 and 11, enabling the friction heat of the tappets 12, 12 to be easily radiated with the result of hardly damaging the tappets 12, 12.

Invention of Claim 9

In addition to the effects presented by the invention as defined in claim 6, it offers the following effect.

<Effect> The oil outlet can be simply formed.

As exemplified in FIG. 2, the crank case 9 is provided with a pump-attaching hole 27 for attaching a fuel injection pump 26 and the laterally oriented hole 28 is constituted by a drilled hole an axis 48 of which passes through the pump-attaching hole 27. Therefore, a drill that has been inserted from the pump-attaching hole 27 into the crank case 9 can form the laterally oriented hole 28. This makes it possible to form the oil outlet 20 simply.

Invention of Claim 10

In addition to the effects presented by the invention as defined in claim 6, it offers the following effect.

<Effect> A plug can be attached simply.

As exemplified in FIG. 2, the laterally oriented hole 28 is set to have its axis 48 pass through the pump-attaching hole 27 through which a tool is inserted into the crank case 9. The tool can attach a plug 32 to an outside opening 31 of the laterally oriented hole 28. Thus the plug 32 can be attached simply.

Invention of Claim 11

In addition to the effect given by the invention as defined in claim 10, it offers the following effect.

<Effect> A plug can be removed easily

As exemplified in FIG. 2, the tool that has been inserted through the pump-attaching hole 27 into the crank case 9 can take the plug 32 out of the outside opening 31 of the laterally oriented hole 28. This makes it possible to remove the plug 32 easily.

MOST PREFERRED EMBODIMENT OF THE INVENTION

An embodiment of the present invention is explained based on the drawings. FIGS. 1 to 5 show an oil-cooled engine according to the embodiment of the present invention. In this embodiment, an explanation is given for an air-and-oil cooled uni-cylinder diesel engine.

The embodiment of the present invention is outlined as follows.

Figure 5:
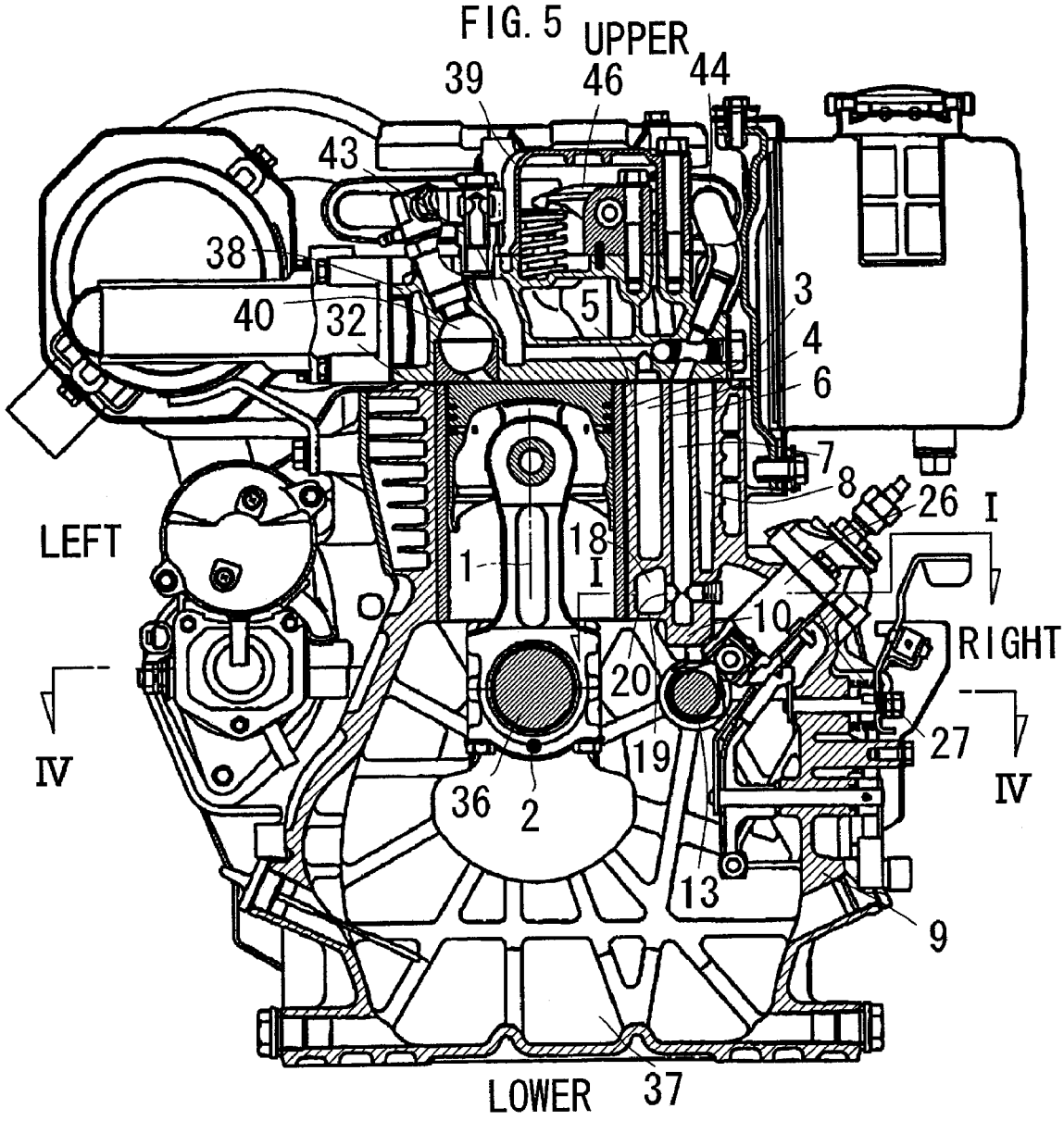
FIG. 5 is a rear view, in vertical section, of the engine according to the embodiment of the present invention.

As shown in FIG. 5, this engine is provided with a cylinder block 35. This cylinder block 35 has a cylinder 5 at an upper portion of a crank case 9, within which a crank shaft 36 spans. The crank case 9 has an inner bottom portion which serves as an oil reservoir 37 where engine oil is stored.

A direction where a cylinder center axis 1 extends is taken as an up and down direction and a direction where a center axis 2 of the crank shaft 36 extends is deemed as a front and rear direction. A direction perpendicular to these directions is regarded as a left and right lateral direction.

Assembled to an upper portion of the cylinder 5 is a cylinder head 38 having an upper portion to which a head cover 39 is assembled. The cylinder head 38 is provided with a sub-combustion chamber 40, which is a swirl chamber.

This engine has a cooling device whose structure is as follows.

Figure 4:
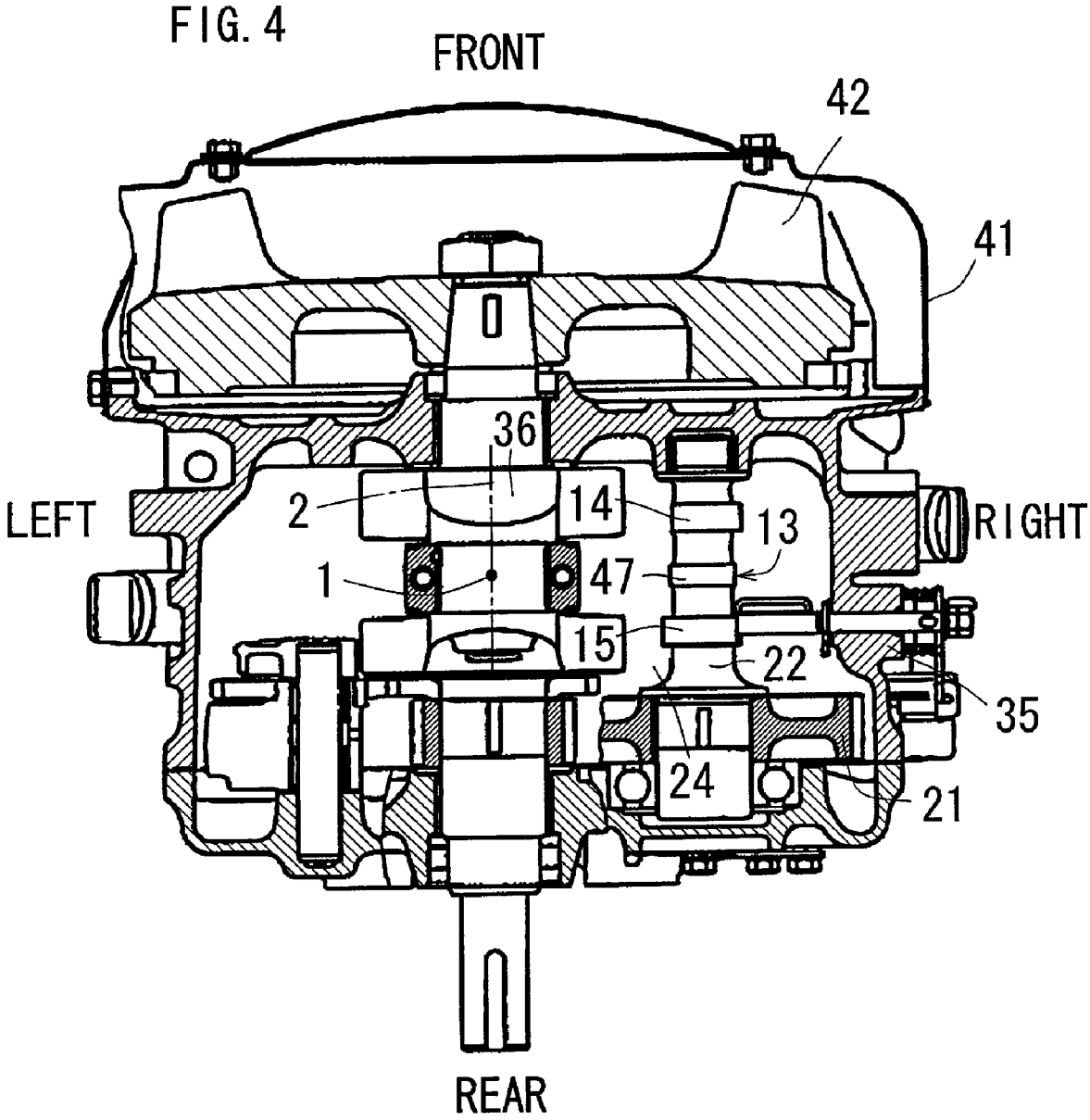
FIG. 4 is a sectional view taken along a line IV-IV in FIG. 5.

As shown in FIG. 4, a fan case 41 is attached in front of the cylinder block 35. The fan case 41 houses a fly wheel fan 42 that is attached to a front end portion of the crank shaft 36. As shown in FIG. 5, a cylinder side oil-cooling jacket 4 is provided along the cylinder 5 and a sub-combustion chamber side oil-cooling jacket 43 is provided along the sub-combustion chamber 40. An oil cooler 44 is arranged above the fan case 41. An oil-return passage 7 is formed along the oil-cooling jacket 4.

As shown in FIG. 5, this cooling device feeds under pressure the engine oil stored in the oil reservoir 37 of the crank case 9 to the oil-cooling jacket 4 by an oil pump (not shown). The engine oil fed under pressure to the oil-cooling jacket 4 passes through the oil-cooling jacket 43 and the oil cooler 44 in the mentioned order and then passes through the oil-return passage 7 to return to the oil reservoir 37 of the crank case 9. This circulation of engine oil cools walls of the cylinder 5 and the sub-combustion chamber 40. Further, the fly wheel fan 42 produces cooling air, which is fed under pressure to the cylinder 5, the cylinder head 8 and the oil cooler 44, thereby air-cooling the cylinder 5, the cylinder head 8 and the oil cooler 44.

The valve-operating device and the oil-return passage have the following relationship.

As shown in FIG. 5, the cylinder side oil-cooling jacket 4 is formed along a cylinder lateral and peripheral wall 3. The oil-return passage 7 and a push-rod chamber 8 are formed along an oil-cooling jacket lateral and peripheral wall 6 disposed, opposite to the cylinder lateral and peripheral wall 3 with the oil-cooling jacket 4 interposed between the cylinder lateral and peripheral wall 3 and the oil-cooling jacket lateral and peripheral wall 6. The oil-return passage 7 and the push-rod chamber 8 are oriented in the up and down direction and the engine oil that has been fed under pressure by the oil pump to the oil-cooling jacket 4 is returned from the oil-return passage 7 into the crank case 9.

The valve-operating device has the following structure.

Figure 1:
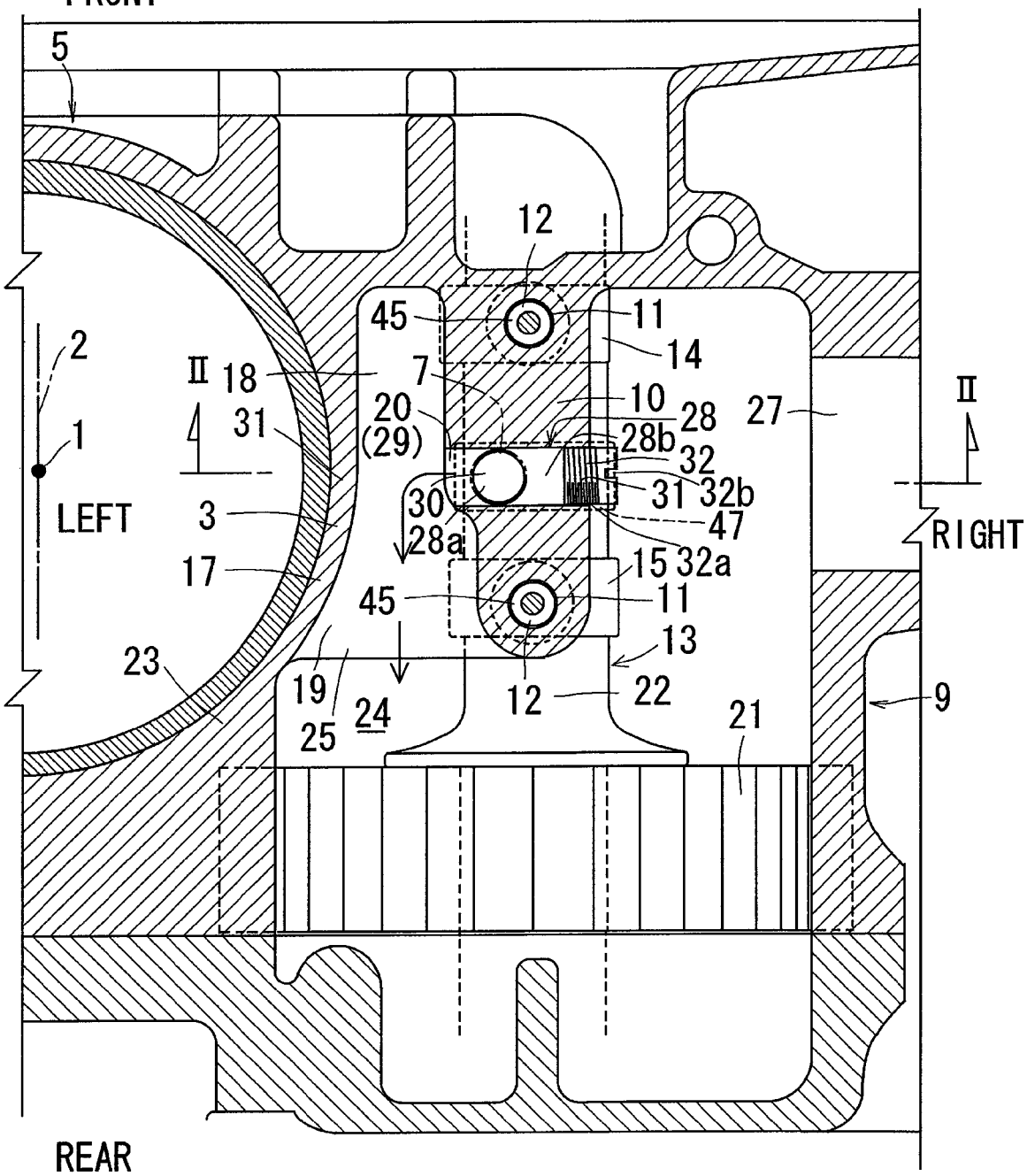
FIG. 1 is a sectional view taken along a line I-I in FIG. 5 and shows essential portions of an engine according to an embodiment of the present invention.

As shown in FIG. 1, the push-rod chamber 8 has a bottom wall 10 opened to provide tappet guide holes 11, 11 into which tappets 12, 12 are internally fitted. A valve-operating cam shaft 13 spans in the front and rear direction below the push-rod chamber bottom wall 10. This valve-operating cam shaft 13 has cams 14 and 15 on which the tappets 12, 12 are placed. Push rods 45, 45 are put on the tappets 12, 12, respectively and drive intake and exhaust valves via a rocker arm 46 as shown in FIG. 5. The valve-operating cam shaft 13 is formed with a fuel injection cam 47 which drives a fuel injection pump 26. The fuel injection cam 47 is arranged between a pair of cams 14, 15 for operating valves.

An oil cooling device is devised as follows.

Figure 2:
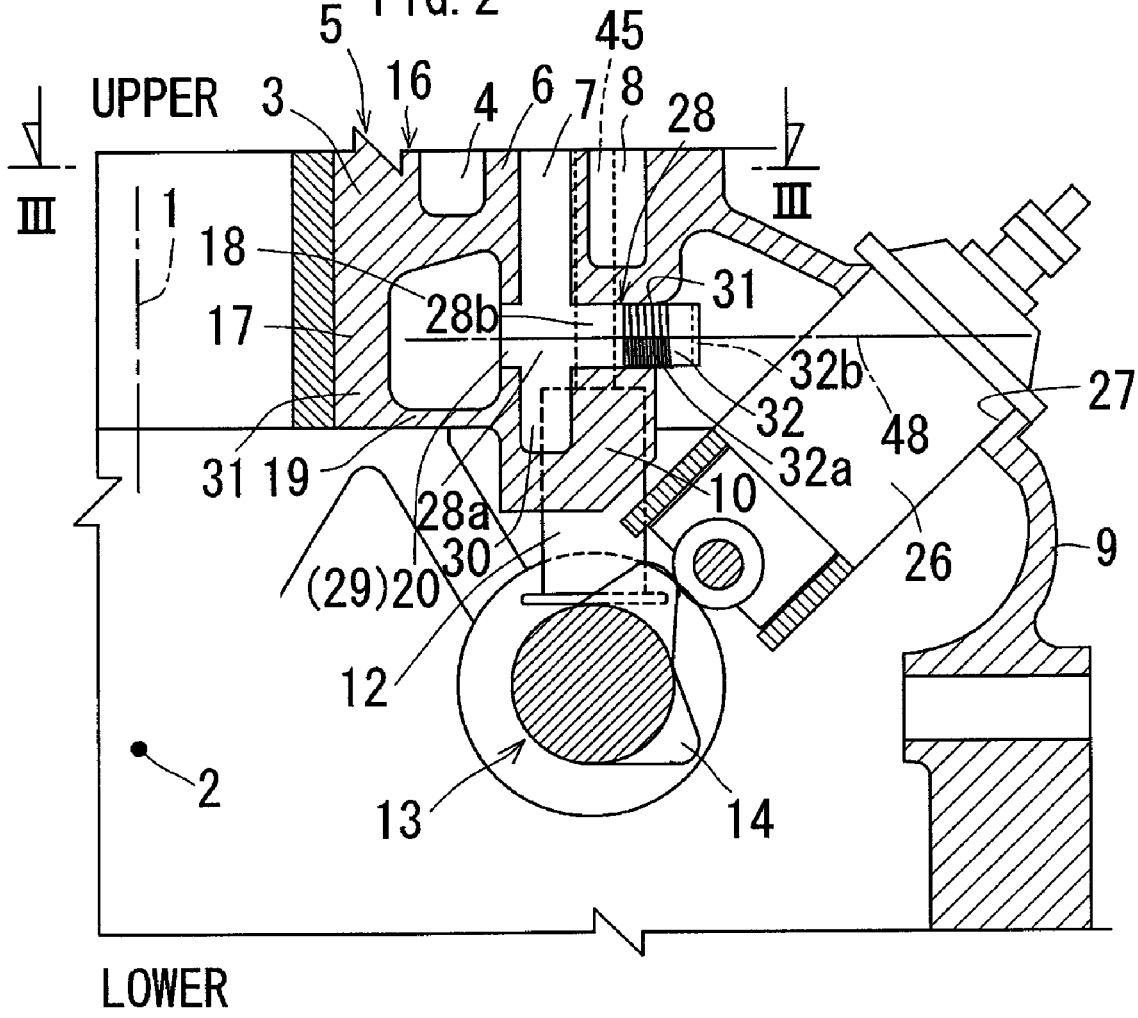
FIG. 2 is a sectional view taken along a line II-II in FIG. 1.
Figure 3:
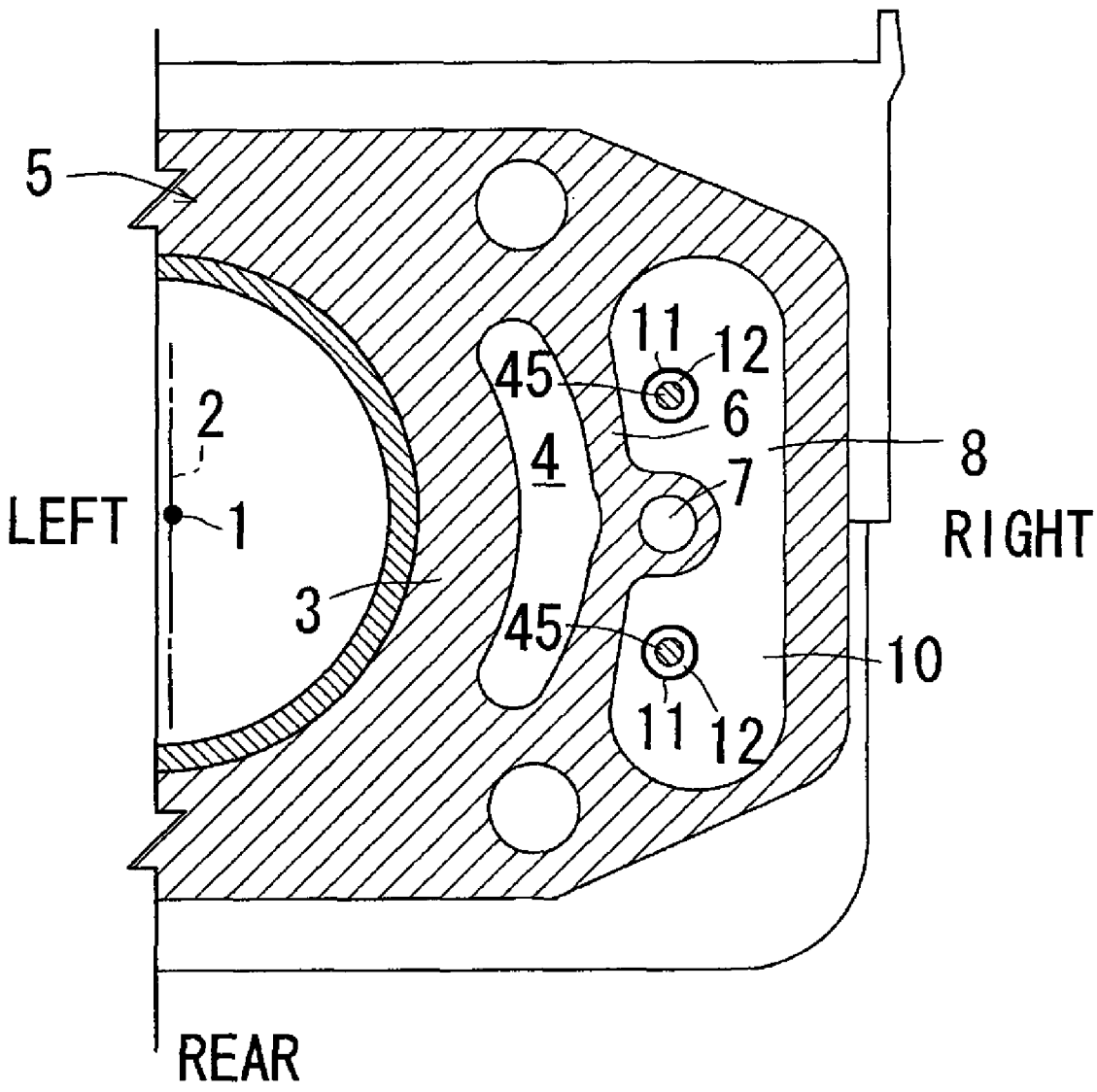
FIG. 3 is a sectional view taken along a line III-III in FIG. 2.

As shown in FIG. 2, an oil-release space 18 is formed along a lower side portion 17 of the cylinder lateral and peripheral wall 3 below the oil-cooling jacket 4. A reinforcing plate 19 spans between the lower side portion 17 of the cylinder lateral and peripheral wall 3 and the push-rod chamber bottom wall 10 below the oil-release space 18. The oil-return passage 7 has an oil outlet 20 communicated with the oil-release space 18. The engine oil that has passed through the oil-return passage 7 is released from the oil outlet 20 to the oil-release space 18.

As shown in FIG. 1, when seen in a direction parallel to the cylinder center axis 1, the valve-operating cam shaft 13 has one end portion to which a valve-operating cam gear 21 is attached. A side where this one end portion of the valve-operating cam shaft 13, which has the valve-operating cam gear 21 attached thereto, is present is deemed to be a rear side. The valve-operating cam shaft is provided with a plurality of cams the rearmost one of which is taken as a rear cam 15. The reinforcing plate 19 is led out from a front end of the oil-release space 18 to a rear side position from the rear cam 15 of the valve-operating cam shaft 13. A portion between the rear cam 15 and the valve-operating cam gear 21 is deemed as a cam-shaft rear side portion 22. A space positioned immediately laterally of this cam-shaft rear side portion 22 and defined between the cam-shaft rear side portion 22 and a rear side portion 23 of the cylinder lateral and peripheral wall 3 is taken as a rear side space 24.

The engine oil released into the oil-release space 18 is guided by an upper surface of the reinforcing plate 19 and is made to drop from the led-out end 25 on the rear side of the reinforcing plate 19 onto the rear side space 24.

As shown in FIG. 2, whole amount of the engine oil that has passed through the oil-return passage 7 is released from the oil outlet 20 into the oil-release space 18.

As shown in FIG. 2, the cylinder lateral and peripheral wall 3, the push-rod chamber bottom wall 10 and the reinforcing plate 19 are parts of a cylinder block 35 which is an integrally formed one-piece cast product including those ones. The cylinder block 35 is a cast product made of an aluminum alloy for a material.

As shown in FIG. 1, a reinforcing plate 19 is provided immediately laterally of each of the tappet guide holes 11, 11.

Also as shown in FIG. 1, the cylinder lateral and peripheral wall 3 which forms a lateral wall of the oil-release space 18 goes further away from the valve-operating cam shaft 13 as it approaches the led-out end 25 on the rear side of the reinforcing plate 19.

As shown in FIGS. 1 and 2, a laterally oriented hole 28 crosses the push-rod chamber bottom wall 10. And the oil-return passage 7 crosses the laterally oriented hole 28. A portion of the laterally oriented hole 28 which is nearer the oil-release space 18 than the crossing portion 28*a* with the oil-return passage 7 is taken as the oil outlet 20. An outside opening 31 of the laterally oriented hole 28, disposed opposite to the oil-release space 18 is sealed by a plug 32. The crossing portion 28*a* and the plug 32 of the laterally oriented hole 28 define a laterally oriented oil reservoir 28*b* therebetween, which is positioned between the paired tappet guide holes 11, 11 adjacent each other.

As shown in FIGS. 1 and 2, a downwardly oriented oil reservoir 30 is formed at a position lower than the crossing portion 28*a* of the laterally oriented hole 28 and is communicated with the crossing portion 28*a*. This downwardly oriented oil reservoir 30 is situated between the paired tappet guide holes 11, 11 adjacent one another.

As shown in FIG. 2, the crank case 9 is provided with a pump-attaching hole 27 for attaching the fuel injection pump 26 thereto. The laterally oriented hole 28 is constituted by a drilled hole an axis 48 of which passes through the pump-attaching hole 27. Thus a drill that has been inserted from the pump-attaching hole 27 into the crank case 9 can form the laterally oriented hole 28.

As shown in FIG. 2, the crank case 9 is provided with the pump-attaching hole 27 for attaching the fuel injection pump 26. The laterally oriented hole 28 is set to have its axis 48 pass through the pump-attaching hole 27. A tool that has been inserted through the pump-attaching hole 27 into the crank case 9 can attach a plug 32 to the outside opening 31 of the laterally oriented hole 28.

Besides, the tool that has been inserted through the pump-attaching hole 27 into the crank case 9 can take the plug 32 out of the outside opening 31 of the laterally oriented hole 28.

The plug 32 has a peripheral surface 32*a* externally threaded and has an end surface formed with a slot 32*b*. A screw driver inserted from the pump-attaching hole 27 into the crank case 9 attaches the plug 32 to the outside opening 31 of the laterally oriented hole 28. Alternatively, another screw driver inserted from the pump-attaching hole 27 into the crank case 9 can take the plug 32 out of the outside opening 31 of the laterally oriented hole 28.

The plug 32 is attached to the outside opening 31 of the laterally oriented hole 28 by using a striking tool. Alternatively, the plug 32 may be taken out of the outside opening 31 of the laterally oriented hole 28 by utilizing an drawing tool.

What is claimed is:

1. An oil-cooled engine, where a direction in which a cylinder center axis (1) extends is taken as an up and down direction and a direction in which a center axis (2) of a crank shaft extends is deemed as a front and rear direction, a direction perpendicular to these directions being regarded as a left and right lateral direction, the oil-cooled engine comprising an oil-cooling jacket (4) formed along a cylinder lateral and peripheral wall (3), an oil-return passage (7) and a push-rod chamber (8) being formed along an oil-cooling jacket lateral and peripheral wall (6), disposed opposite to the cylinder lateral and peripheral wall (3) with the oil-cooling jacket (4) interposed between the cylinder lateral and peripheral wall (3) and the oil-cooling jacket lateral and peripheral wall (6), the oil-return passage (7) and the push-rod chamber (8) being oriented in the up and down direction, an oil pump feeding under pressure, engine oil which is returned from the oil-return passage (7) into a crank case (9), the push-rod chamber having a bottom wall (10) opened to provide tappet guide holes (11), (11) into which tappets (12), (12) are internally fitted, a valve-operating cam shaft (13) spanning in the front and rear direction below the push-rod chamber bottom wall (10), the valve-operating cam shaft (13) having cams (14), (15) on which tappets (12), (12) are placed, wherein an oil-release space (18) is formed along a lower side portion (17) of the cylinder lateral and peripheral wall (3) below the oil-cooling jacket (4), a reinforcing plate (19) spanning between the lower side portion (17) of the cylinder lateral and peripheral wall (3) and the push-rod chamber bottom wall (10) below the oil-release space (18), the oil-return passage (7) having an oil outlet (20) communicated with the oil-release space (18), the engine oil that has passed through the oil-return passage (7) being released from the oil outlet (20) to the oil-release space (18), when seen in a direction parallel to the cylinder center axis (1), the valve-operating cam shaft (13) having one end portion to which a valve-operating cam gear (21) is attached, a side where the one end portion of the valve-operating cam shaft (13), which has the valve-operating cam gear (21) attached thereto is present being deemed as a rear side, the valve-operating cam shaft (13) being provided with a plurality of cams the rearmost one of which is taken as a rear cam (15), the reinforcing plate (19) being led out from a front end of the oil-release space (18) to a rear side position from the rear cam (15) of the valve-operating cam shaft (13), a portion between the rear cam (15) and the valve-operating cam gear (21) being deemed as a cam-shaft rear side portion (22), a portion located immediately laterally of the cam-shaft rear side portion (22) and defined between the cam-shaft rear side portion (22) and a rear side portion (23) of the cylinder lateral and peripheral wall (3) being taken as a rear side space (24), the engine oil released into the oil-release space (18) being guided by an upper surface of the reinforcing plate (19) and being made to drop from a led-out end 25 on a rear side of the reinforcing plate (19) onto the rear side space (24).

2. The oil-cooled engine as set forth in claim 1, wherein whole amount of the engine oil that has passed through the oil-return passage (7) is released from the oil outlet (20) into the oil-release space (18).

3. The oil-cooled engine as set forth in claim 1, wherein the cylinder lateral and peripheral wall (3), the push-rod chamber bottom wall (10) and the reinforcing plate (19) are parts of an integrally formed one-piece cast product including those ones.

4. The oil-cooled engine as in claim 1, wherein a reinforcing plate (19) is provided immediately laterally of each of the tappet guide holes (11), (11).

5. The oil-cooled engine as set forth in claim 1, wherein the cylinder lateral and peripheral wall (3) which forms a lateral wall of the oil-release space (18) goes further away from the valve-operating cam shaft (13) as it approaches the led-out end (25) on the rear side of the reinforcing plate (19).

6. The oil-cooled engine as set forth in claim 1, wherein a laterally oriented hole (28) crosses the push-rod chamber bottom wall (10), and the oil-return passage 7 crosses the laterally oriented hole 28, a portion of the laterally oriented hole (28) which is nearer the oil-release space (18) than the crossing portion (28*a*) with the oil-return passage (7) being taken as the oil outlet (20), an outside opening (31) of the laterally oriented hole (28), disposed opposite to the oil-release space (18) being sealed by a plug (32).

7. The oil-cooled engine as set forth in claim 6, wherein the crossing portion (28*a*) and the plug (32) of the laterally oriented hole (28) define a laterally oriented oil reservoir (28*b*) therebetween, which is positioned between the paired tappet guide holes (11), (11) adjacent each other.

8. The oil-cooled engine as set forth in claim 6, wherein a downwardly oriented oil reservoir portion (30) is formed at a position lower than the crossing portion (28*a*) of the laterally oriented hole (28), the downwardly oriented oil reservoir portion (30) being communicated with the crossing portion (28*a*) and being situated between the paired tappet guide holes (11), (11) adjacent one another.

9. The oil-cooled engine as set forth in claim 6, wherein the crank case (9) is provided with a pump-attaching hole (27) for attaching a fuel injection pump (26), the laterally oriented hole (28) being constituted by a drilled hole an axis (48) of which passes through the pump-attaching hole (27), a drill that has been inserted from the pump-attaching hole (27) into the crank case (9) being able to form the laterally oriented hole (28).

10. The oil-cooled engine as set forth in claim 6, wherein the crank case (9) is provided with the pump-attaching hole (27) for attaching the fuel injection pump (26), the laterally oriented hole (28) being set to have its axis (48) pass through the pump-attaching hole (27), a tool that has been inserted from the pump-attaching hole (27) into the crank case (9) being able to attach the plug (32) to the outside opening (31) of the laterally oriented hole (28).

11. The oil-cooled engine as set forth in claim 10, wherein the tool that has been inserted from the pump-attaching hole (27) into the crank case (9) is able to take the plug (32) out of the outside opening (31) of the laterally oriented hole (28).

* * * * *